US006902123B2

(12) United States Patent
Grether et al.

(10) Patent No.: US 6,902,123 B2
(45) Date of Patent: Jun. 7, 2005

(54) SANITARY FITTING

(75) Inventors: Hermann Grether, Müllheim (DE); Christoph Weis, Lörrach (DE)

(73) Assignee: Dieter Wildfang GmbH, Mullheim (DE)

( * ) Notice: Subject to any disclaimer, the term of this patent is extended or adjusted under 35 U.S.C. 154(b) by 138 days.

(21) Appl. No.: 10/297,499

(22) PCT Filed: May 31, 2001

(86) PCT No.: PCT/EP01/06189

§ 371 (c)(1),
(2), (4) Date: Dec. 6, 2002

(87) PCT Pub. No.: WO01/96673

PCT Pub. Date: Dec. 20, 2001

(65) Prior Publication Data

US 2003/0141384 A1 Jul. 31, 2003

(30) Foreign Application Priority Data

Jun. 6, 2000 (DE) ..... 100 27 986

(51) Int. Cl.[7] ..... E03C 1/08

(52) U.S. Cl. ..... 239/428.5; 239/553.2; 239/590.3

(58) Field of Search ..... 239/428.5, 553.2, 239/590.3, 553.3; 137/504

(56) References Cited

U.S. PATENT DOCUMENTS 2,754,097 A * 7/1956 Hjulian ..... 239/428.5
2,962,225 A * 11/1960 Agnides ..... 239/428.5

(Continued)

FOREIGN PATENT DOCUMENTS

DE 300799 A1 * 1/1980 ..... 239/428.5
DE 3000799 7/1981
DE 3440883 A1 * 11/1984 ..... 239/428.5
DE 8527320.1 11/1987
DE 29510618 10/1995
DE 29510618 U1 * 10/1995 ..... 239/428.5
DE 29718727.9 10/1997

*Primary Examiner*—David A. Scherbel
*Assistant Examiner*—James S. Hogan
(74) *Attorney, Agent, or Firm*—Volpe and Koenig, P.C.

(57) ABSTRACT

The invention relates to a sanitary fitting (5) including an external housing (2) that has at least one housing section (6, 7, 30), the housing section (6, 7, 30) having an insertion opening (10) on an inlet side. At least one functional unit can be inserted through said opening into the interior of the housing until it abuts an insertion stop (18, 19, 29). A housing clearance (20, 21, 22) for receiving the protruding part of the functional unit(s) that projects beyond the insertion stop is located upstream and/or downstream of the insertion stop (18, 19, 29) in the direction of insertion. The inventive fitting is characterized in that the fitting (5) optionally includes several different functional units and that the housing clearance (20, 21, 22) located upstream and/or downstream of the insertion stop(s) (18, 19, 29) has a longitudinal extension in the direction of insertion, which is equal to or greater than the maximum distance between the insertion stop (18, 19, 20) and the front face of the functional unit(s) in the fitting (5), the front face projecting into the housing clearance (20, 21, 22). Despite its modular configuration, the inventive fitting (5) can thus be simply mounted in the outflow mouth of a sanitary outflow fixture.

11 Claims, 4 Drawing Sheets

U.S. PATENT DOCUMENTS 3,363,841 A * 1/1968 Aghnides ..... 239/428.5
3,417,924 A * 12/1968 Aghnides ..... 239/428.5
3,684,191 A * 8/1972 Shames et al. ..... 239/428.5
4,000,857 A * 1/1977 Moen ..... 239/428.5
4,470,546 A * 9/1984 Wildfang ..... 239/428.5
4,789,103 A * 12/1988 Ruhnke ..... 239/428.5
4,862,913 A * 9/1989 Wildfang ..... 137/543
4,976,283 A * 12/1990 Wildfang et al. ..... 137/504
5,114,072 A * 5/1992 Barhydt, Sr. ..... 239/428.5
5,184,641 A * 2/1993 Kuhn ..... 137/504
5,348,231 A * 9/1994 Arnold et al. ..... 239/428.5
5,495,985 A * 3/1996 Nehm et al. ..... 239/428.5
5,769,326 A * 6/1998 Muchenberger et al. . 239/428.5
5,803,368 A * 9/1998 Shekalim ..... 239/428.5
6,126,093 A * 10/2000 Grether et al. ..... 239/428.5
6,152,182 A * 11/2000 Grether et al. ..... 138/42
6,409,100 B1 * 6/2002 Lundberg ..... 239/428.5

* cited by examiner

SANITARY FITTING

BACKGROUND

The invention relates to a sanitary fitting having an external housing that has at least one housing section, said housing section having an insertion opening at the inlet side through which at least one functional unit can be inserted into the interior of the housing up to an allocated insertion stop, a housing clearance being situated upstream and/or downstream from the at least one insertion stop in the direction of insertion, in order to accept the projecting part, which protrudes past the insertion stop, of the at least one functional unit.

Jet regulators, flow limiters, flow controllers, and other sanitary fittings are known that can be used individually or in combination in the outflow mouth of a sanitary outflow armature, for example for the aeration of the water jet, or for the homogenization or limiting of the water quantity flowing through per time unit.

Thus, from DE 30 00 799 C3 a jet regulator is known whose external housing is formed by a sleeve-type housing section. This housing section is situated in an outflow mouth that can be fastened to the outer threading of a sanitary outflow armature with an inner threading at the front edge. The housing section has an insertion opening at the inlet side, through which a jet divider device, as well as a jet regulating device, can be inserted up to an allocated stop in the interior of the housing. While the jet divider device at the inlet side is formed by a perforated plate, a plurality of jet regulating sieves or screens connected downstream at the outlet side are used as a jet regulating device. In order to enable the projecting part, which protrudes past the insertion stop, of these functional units to be accepted in the interior of the housing, a housing clearance is preferably provided downstream from the insertion stop in the direction of insertion.

From DE 195 10 734 A1, a sanitary fitting is known that has a jet regulator and an attachment sieve at the inlet side. If necessary, a flow regulator can be connected intermediately between the attachment sieve and the functional unit connected downstream at the outlet side. For this purpose, the jet regulator, flow regulator, and attachment sieve have complementary locking means on their mutually facing end surfaces.

Due to the intermediate connection of the flow regulator, the known sanitary fitting requires a larger constructive length. However, since in the outflow mouth of a sanitary outflow armature only a limited constructive height is available for the installation of such a fitting, the attachment sieve and the flow regulator have a smaller diameter in comparison with the jet regulator, in order to be able to project into the inner flow cross-section of the sanitary outflow armature.

This known fitting can advantageously be used with various outflow armatures that have a sufficient, approximately equal flow cross-section. However, the inner flow cross-section of the outflow armature is not always available to such a fitting, if the different sanitary armatures of different manufacturers differ from one another strongly in their inner flow cross-section.

SUMMARY

The problem therefore arises of creating a versatile sanitary fitting of the type specified above that can in every case be housed in the outflow mouth of a sanitary outflow armature, and whose manufacture is nonetheless possible with a comparatively low expense.

In the sanitary fitting of the type named above, a solution of this problem according to the present invention is, in particular, that the fitting is of modular construction, and that its external housing has for this purpose at least two housing sections that can be connected with one another, into which a plurality of different functional units can each optionally be inserted up to an insertion stop, and that the housing clearance situated upstream and/or downstream, in the direction of insertion, from the at least one insertion stop has a longitudinal extension that is greater than or equal to the maximum distance between the insertion stop on the one hand and the front side, protruding into this housing clearance, of the functional units allocated to the respective housing section on the other hand.

Various functional units are allocated to the fitting according to the present invention that can optionally be combined with one another. These functional units can be inserted into the housing interior through the insertion opening of a housing section up to an allocated insertion stop. Here, the housing clearance situated upstream and/or downstream from an insertion stop has a longitudinal extension that is greater than or equal to the maximum distance between the insertion stop on the one hand and the front side, protruding into this housing clearance, of the functional units allocated to the fitting on the other hand. So that in this way all functional units allocated to the fitting will find space in the interior of the housing, the external housing of the fitting according to the present invention has a height that remains constant at all times, and that is matched to the existing constructive height in the outflow mouths of sanitary outflow armatures, practically without also having to take into account the inner flow cross-section at the inlet side of such an outflow armature. Since each fitting can thus be assembled from functional units and housing sections that can be combined with one another, the manufacture of the fitting according to the present invention is connected with a low manufacturing expense.

In a sanitary fitting of the type named above, a further proposal for the solution according to the invention of the underlying problem is that the fitting is of modular construction, and that in addition a functional unit formed as a flow regulator or as a flow limiter can be inserted into the housing clearance as needed. Thus, for example, a flow regulator can be allocated to the fitting according to the present invention that can be inserted into the housing clearance of the external housing as needed without thereby altering the constructive height of the sanitary fitting, and without also having to take into account the inner flow cross-section at the affluent side of an outflow armature.

After the insertion of the required functional units, the housing sections forming an external housing can be connected with one another by gluing, welding, or the like. However, a specific embodiment according to the present invention that is particularly simple to manufacture, and is therefore preferred, provides that the at least two housing sections can be locked with one another, or connected with one another in a similarly detachable fashion.

In order to enable the housing sections of the fitting according to the present invention to be connected with one another not only solidly but also as tightly as possible, a preferred specific embodiment according to the present invention provides that two adjacent housing sections engage with one another at their front edges, and that a first housing section has at least one locking projection that engages in an allocated locking recess in the other housing section. Here, it is advantageous if the locking recess, and preferably also the locking projection, are situated on the housing sections in annular, circumferential fashion.

It is for example also possible for the sanitary fitting, or at least one of its functional units, to be formed as a jet regulator, flow regulator, flow limiter, or non-return valve.

Thus, a preferred specific embodiment according to the present invention provides that the fitting, formed as a jet regulator, has at least one functional unit at the inlet side formed as a flow divider device, as well as at least one functional unit at the outlet side formed as a jet regulator device. Such a fitting thus has all the functional units that are minimally required for a jet regulator.

Here it is advantageous if the fitting has at least one jet regulator device at the outlet side that has at least one perforated plate or honeycomb plate, and/or at least one flow regulator sieve connected upstream from the perforated plate or honeycomb plate.

Such a jet regulator can for example be formed as a non-ventilated jet regulator, if, e.g. for reasons of hygiene, an additional aeration of the flowing jet of water is not desired. However, a specific embodiment is preferred in which at least one housing section, preferably at the outlet side, has at least one ventilation opening for the aeration of the flowing jet of water.

According to a development of the present invention having independent significance that should be separately protectable, it is provided that the fitting has at least two optionally usable housing sections, of which at least one housing section has at least one ventilation opening and at least one other housing section is not ventilated.

It is useful if the fitting is of modular construction. In this way, the required jet regulator, flow limiter, flow regulator, non-return valve, or similar fitting can be assembled as needed and combined from the housing sections and functional units that are present in such a modular system.

The functional reliability of such a sanitary fitting can be further increased if an attachment sieve is connected upstream from the fitting at the inlet side.

BRIEF DESCRIPTION OF THE DRAWINGS

Additional features of the invention result from the following description of exemplary embodiments of the present invention, in connection with the claims as well as the drawing. The individual features can be realized independently or in combination in a specific embodiment according to the present invention.

DETAILED DESCRIPTION OF THE PREFERRED EMBODIMENTS

Figure 1:
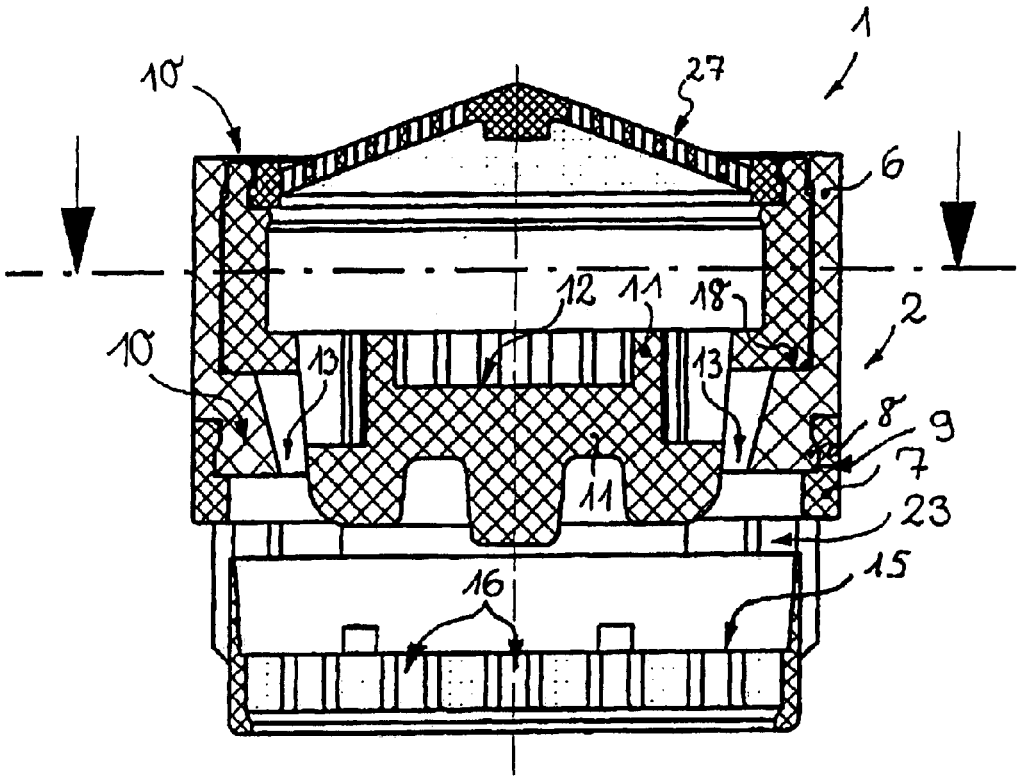
FIG. 1 shows a sanitary fitting, formed here as a ventilated jet regulator, and additionally having in its housing interior a jet divider device as well as a jet regulator device connected downstream at the outlet side.
Figure 2:
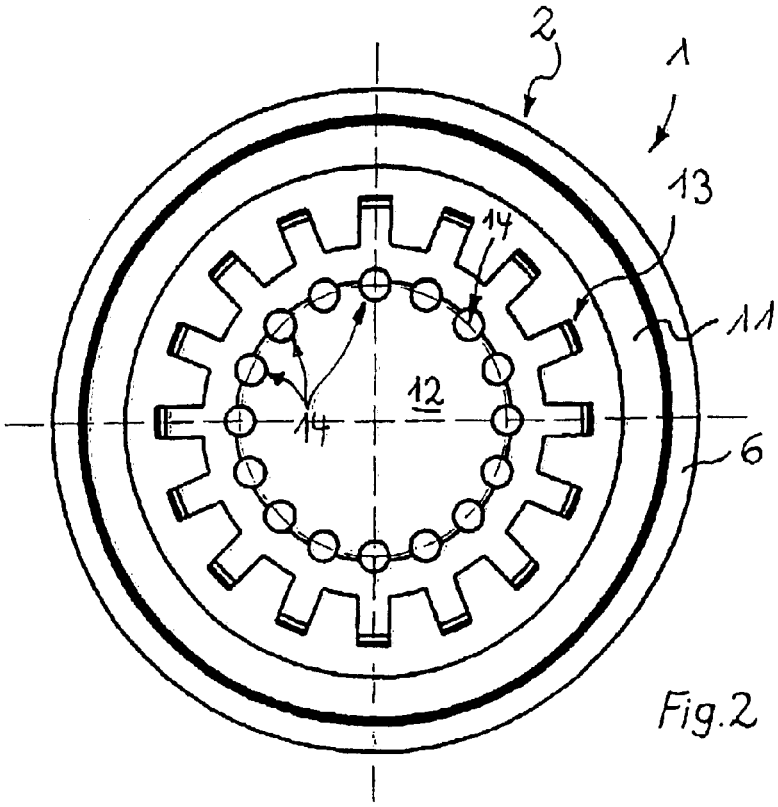
FIG. 2 shows the fitting in a top view of its face at the inlet side.

In FIGS. 1 to 5, various sanitary fittings 1, 3, 4, and 5 are shown that can be inserted into an outflow mouth of a sanitary outflow armature (not shown in more detail here).

Each of fittings 1, 3, 4, and 5 has an external housing 2 having at least two housing sections 6, 7. A comparison of FIGS. 1 to 5 shows clearly that housing sections 6, 7 engage with one another at their front edges. On inlet side housing section 6, a locking projection 8 is provided that protrudes into the interior of outlet housing section 7, and there engages in an allocated locking groove or similar locking recess 9. Locking projection 8 and locking recess 9 are situated on housing sections 6, 7 in an annular, circumferential fashion.

Each of housing sections 6, 7 has an insertion opening 10 at the inlet side, through which at least one functional unit can be inserted into the interior of the housing up to an insertion stop. Housing sections 6, 7, as well as the functional units of fittings 1, 3, 4 and 5, are optionally usable components, which can also be combined with one another if necessary, of an associated modular system. This modular system has various functional units that can be used optionally.

Thus, a jet divider device 11 and a jet regulator device are allocated to each of fittings 1, 3, 4 and 5, each of which is formed as a jet regulator. Jet divider device 11, situated in housing section 6 at the inlet side, has a divider plate 12 whose plate plane is situated transverse to the direction of flow. This divider plate 12 has duct-type flow guide openings 13, arranged radially at the outer edge, and a pin 14 oriented in the longitudinal direction of the fitting is connected upstream from each of these flow guide openings 13, on the inlet-side plate plane of the divider plate 12. The water jet impinging on divider plate 12 is braked in this way, is diverted in the area of pins 14, and is divided into a multiplicity of individual jets in flow guide openings 13. These individual jets are recombined in the jet regulator device, which is situated downstream in the direction of flow, to form a soft, homogeneous overall jet that does not spray. Here, the cap-type jet divider device 11 is seated, with an outer annular flange that acts as a counter-stop, on an inwardly protruding annular shoulder, acting as an insertion stop 18, on the inner periphery of housing section 6.

The jet regulator device of all fittings 1, 3, 4, and 5 has a perforated plate 15, provided on the face of housing section 7 at the outlet side, that can have for example hexagonal flow-holes 16 arranged in a honeycomb pattern relative to one another. This perforated plate 15 can be inserted into housing section 7 or, as here, can be integrally formed in one piece with housing section 7.

Figure 3:
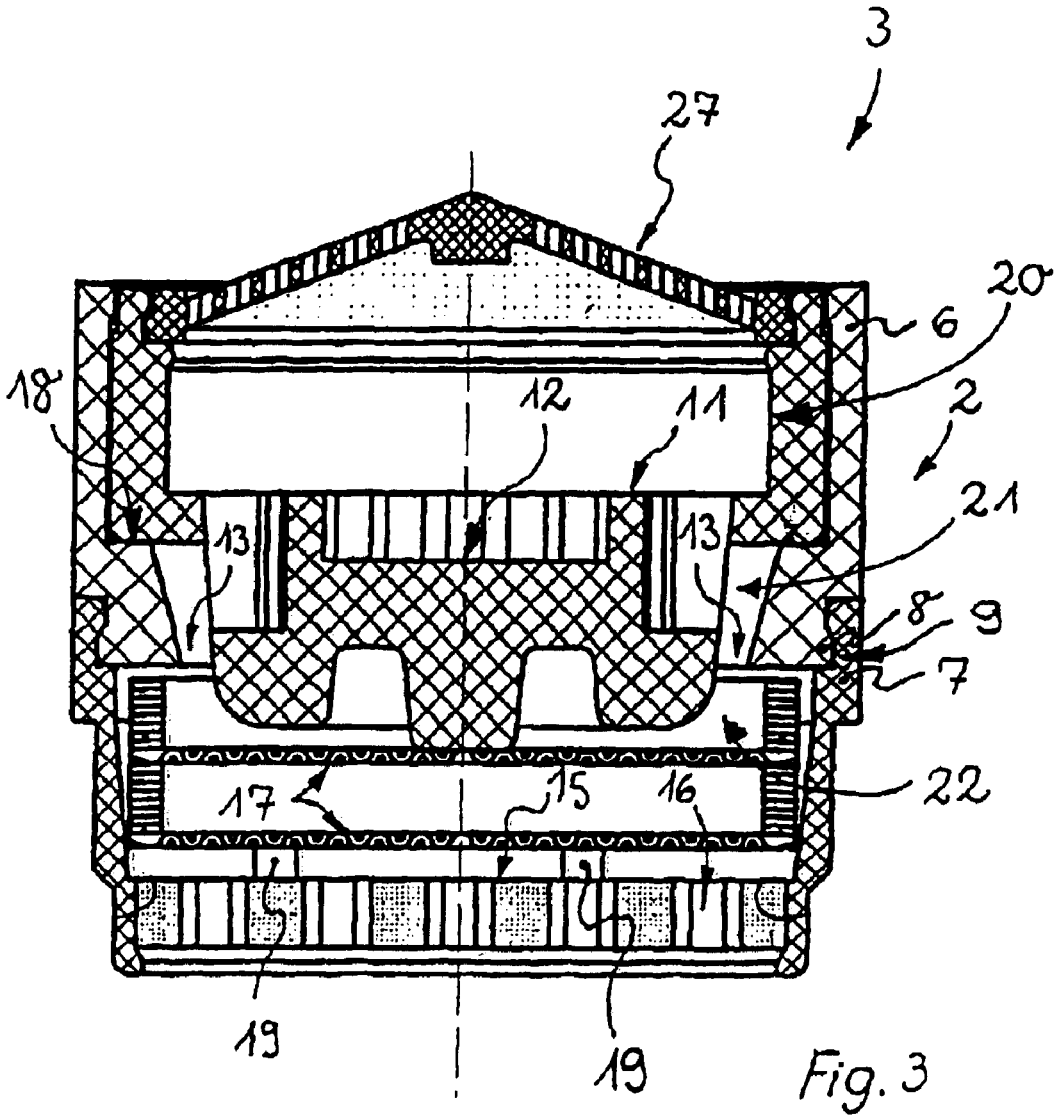
FIG. 3 shows a sanitary fitting similar to that shown in FIGS. 1 and 2, formed here as a non-ventilated jet regulator.

In order to enable a good homogenization of the exiting overall jet to be achieved also in the non-ventilated jet regulator shown in FIG. 3, its jet regulator device additionally has a plurality of jet regulator sieves 17 situated with a small spacing from one another. These jet regulator sieves 17, which form a functional unit, are inserted into housing section 17, and their end face, serving as a counter-stop, abuts on support cams or support bearings 19 that act as insertion stop 19 and are integrally formed onto the face of perforated plate 15 at the inlet facing side.

In external housing 2, a housing clearance 20 is situated upstream from insertion stop 18, and an additional housing clearance 21 is situated downstream from said stop in the direction of insertion, in order to enable acceptance of the projection, at the inlet and outlet side, of jet divider device 11.

Here, housing clearance 21 coincides at least partially with housing clearance 22, which is situated upstream from support cams or support bearings 19 in order to accept jet regulator sieve 17.

Housing clearances 20, 21, and 22 are dimensioned in their longitudinal extension such that they are greater than or equal to the maximum spacing between the corresponding insertion stops 18, 19 on the one hand and the functional unit end surface, protruding into housing clearances 20, 21, or 22, of the functional units allocated to fitting 1, 3, 4 and 5.

While the longitudinal extension of housing clearance 22, situated upstream from support cams or supports 19 acting as an insertion stop, is matched to the longitudinal extension of the functional unit formed by jet regulation sieve 17, the longitudinal extension of housing clearances 20, 21 is oriented toward the projection, at the inlet and outlet side, of jet divider device 11.

As a comparison of FIGS. 1 and 3 makes clear, two differently formed housing sections 7 are provided that can be used optionally as needed. While housing section 7 in FIG. 3 is not ventilated, housing section 7 in FIG. 1 has a plurality of slit-type ventilation openings 23 in order to enable aeration of the water jet flowing through.

Figure 4:
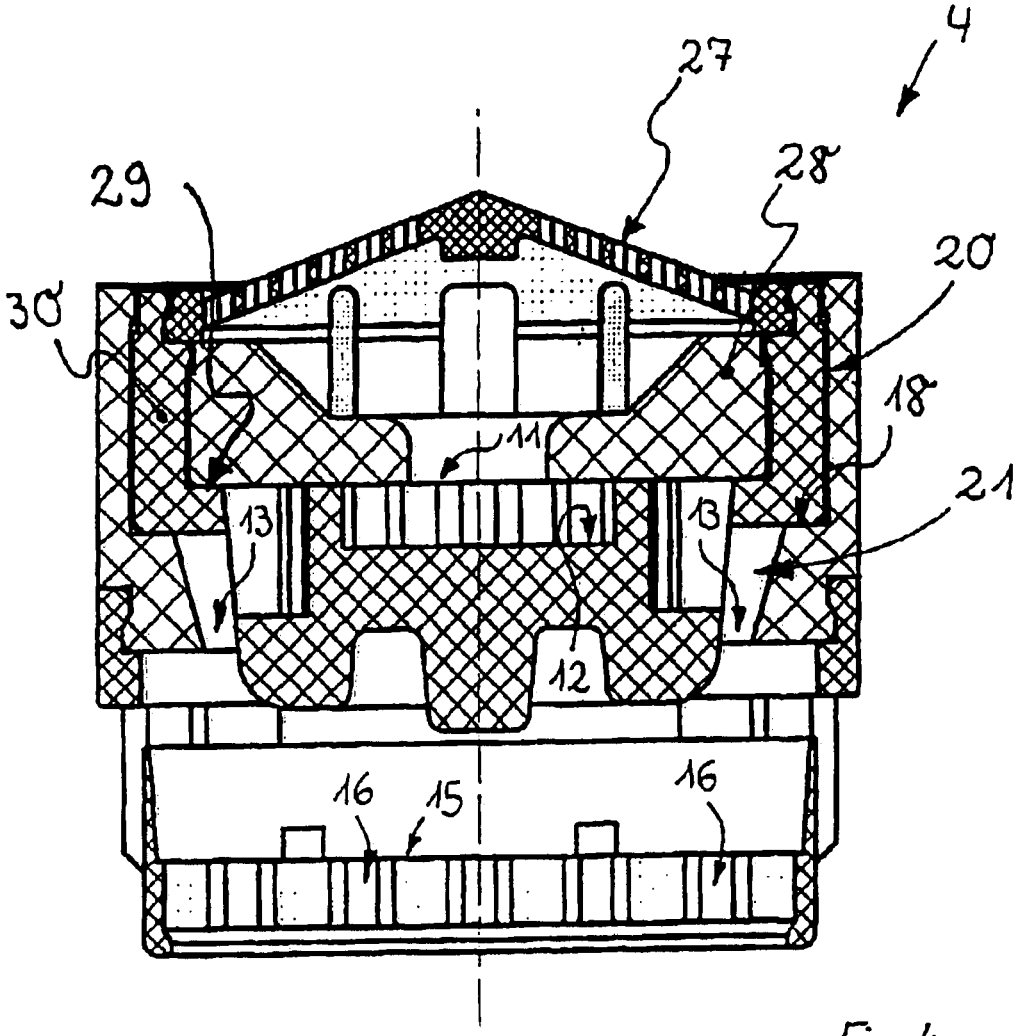
FIG. 4 shows the sanitary fitting from FIGS. 1 and 2, an additional flow limiter at the inlet side being inserted into the housing interior of this fitting.
Figure 5:
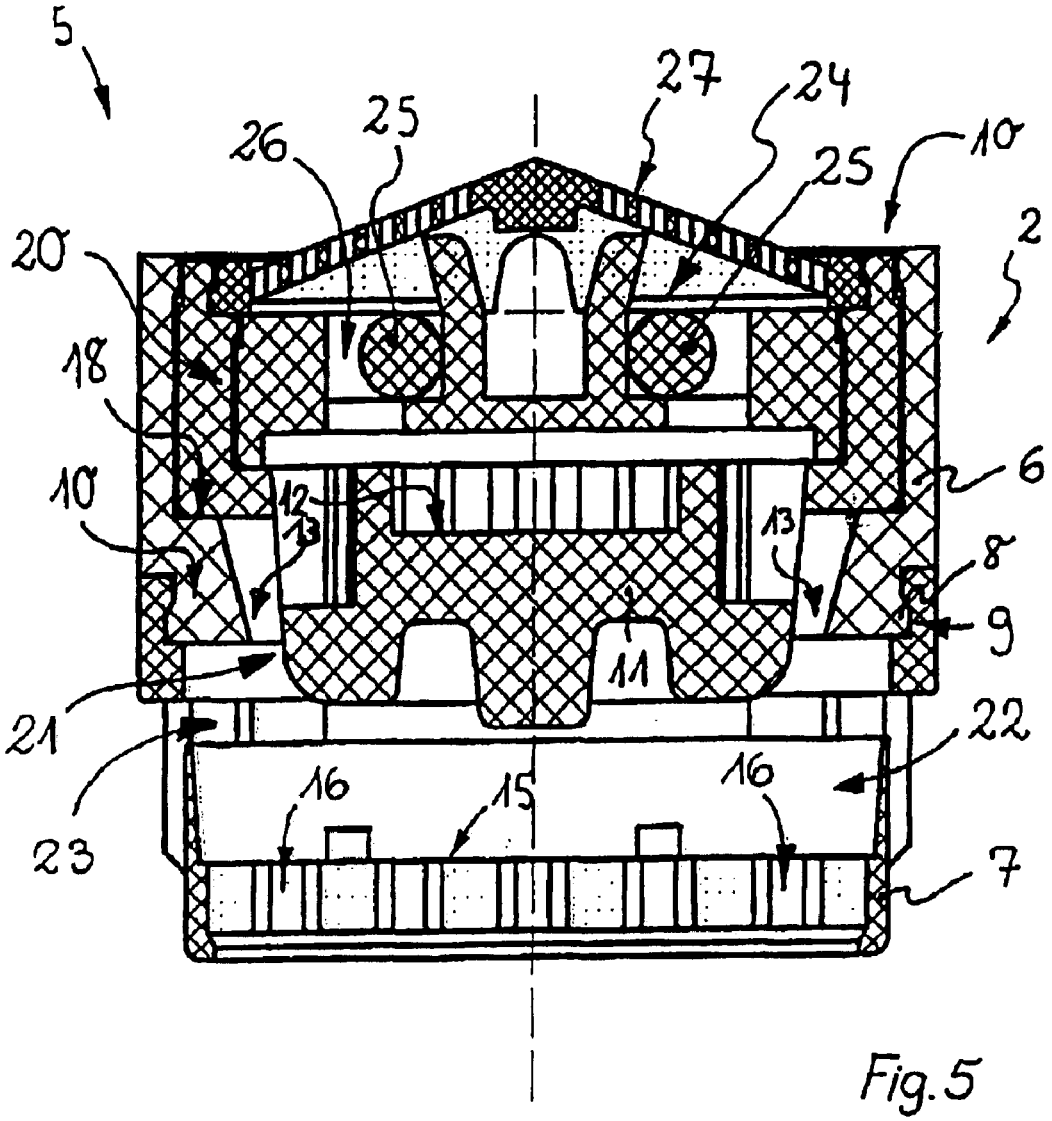
FIG. 5 shows a sanitary fitting similar to that shown in FIG. 4, the fitting shown here having a flow regulator instead of a flow limiter.

From a comparison of FIGS. 1 and 3 on the one hand and FIGS. 4 and 5 on the other hand, it can be seen that fittings 4, 5 have an additional separate housing section 30 that is placed on insertion stop 18. This housing section 30 has an annular flange that protrudes radially inwardly, whose annular surface at the inlet side acts as insertion stop 29 for functional units situated upstream, such as for example cap-type jet divider device 11.

Additional functional units can be inserted into the cap opening of cap-type jet divider device 11. Thus, fitting 4 in FIG. 4 has a flow limiter 28 that is essentially formed as an annular disk or throttle disk, and that narrows the flow-through cross-section. In contrast, instead of this, a flow regulator 24 is inserted into the cap opening of jet divider device 11 allocated to fitting 5, said flow regulator having a regulating element, formed as a rubber ring, made of an elastomeric material. Regulating element 25 of this flow regulator 24 limits, between itself and the adjacent flow regulator inner periphery, a control gap 26 whose inner flow cross-section is modified by regulating element 25, which deforms under the water pressure.

In order to further increase the functional reliability of fittings 1, 3, 4, and 5, an attachment sieve 27 is connected upstream from these at the inlet side. This attachment sieve can be locked in detachable fashion with its outer edge to the front inner edge of jet divider device 11.

Because fittings 1, 3, 4, and 5 shown here always have a constant constructive height despite their modular construction, they can unproblematically be housed in the outflow mouth of a sanitary outflow armature. Here, the modular construction of fittings 1, 3, 4, and 5 promotes a low manufacturing expense.

What is claimed is:

1. Sanitary fitting (1, 3, 4, and 5) comprising an external housing (2) that has at least one housing section (6, 7, 30), said housing section (6, 7, 30) having an insertion opening (10) at an inlet side through which at least one functional unit can be inserted into an interior of the housing up to at least one insertion stop (18, 19, 29), a housing clearance (20, 21, 22) being situated upstream and downstream from the at least one insertion stop (18, 19, 29) in a direction of insertion, in order to accept a projecting part, which protrudes past the insertion stop (18, 19, 29), of the at least one functional unit, the fitting (1, 3, 4, and 5) is of modular construction, and the at least one housing section comprises at least two housing sections (6, 7) that can be connected with one another, into which a plurality of different ones of the functional units can each optionally be inserted up to a respective one of the at least one insertion stop (18, 19, 29), of each of the housing sections, and the housing clearance (20, 21, 22) situated upstream and downstream has a longitudinal extension that is greater than or equal to a maximum distance between the insertion stop (18, 19, 29) and a front side, protruding into the housing clearance (20, 21, 22), of the functional units allocated to the respective housing section (6, 7, 30).

2. Fitting as recited in claim 1, wherein the fitting (1, 3, 4, and 5) is of modular construction, and into which, in addition, a functional unit formed as a flow regulator (24) or as a flow limiter (28) can be inserted into the housing clearance (20, 21, 22) as needed.

3. Fitting as recited in claim 1, wherein the at least two housing sections (6, 7) can be locked together with one another, or can be connected with one another in a detachable fashion.

4. Fitting as recited in claim 1, wherein the two adjacent housing sections (6, 7) engage with one another at a front edge, and the first housing section (6) has at least one locking projection (8) that engages in a locking recess (9) in the other housing section (7).

5. Fitting as recited in claim 4, wherein the locking recess (9), and the locking projection (8), are arranged in an annular, circumferential fashion on the housing sections (6, 7).

6. Fitting as recited in claim 1, wherein the sanitary fitting (1, 3, 4, 5), or at least one of its functional units, is formed as a jet regulator, flow regulator, flow limiter, or non-return valve.

7. Fitting as recited in claim 1, wherein the fitting, formed as a jet regulator, has at least one functional unit at the inlet side formed as a jet divider device (11), as well as at least one functional device at an outlet side formed as a jet regulator device.

8. Fitting as recited in claim 1, wherein at least one jet regulator device, formed as a perforated plate (15) and/or having at least one jet regulator sieve (17), is allocated to the fitting (1, 3, 4, 5).

9. Fitting as recited in claim 1, wherein the at least one housing section (7) has at least one ventilation opening (23) for aeration of the water jet flowing therethrough.

10. Fitting as recited in claim 1, wherein the at least one housing section comprises at least two housing sections (7) that can be used, of which the at least one housing section (7) has at least one ventilation opening (23), and at least one other of the at least two housing sections is not ventilated.

11. Fitting as recited in claim 1, wherein an attachment sieve (27) is connected upstream from the external housing (2), at the inlet side.

* * * * *